US005509607A

United States Patent [19]

Booher et al.

[11] Patent Number: 5,509,607

[45] Date of Patent: Apr. 23, 1996

[54] CONVERTIBLE MEDIA SOOTBLOWER LANCE TUBE

[75] Inventors: Joel H. Booher, Pickerington; Cevdet G. Koksal; Ronald E. Sherrick, both of Lancaster, all of Ohio

[73] Assignee: The Babcock & Wilcox Company, New Orleans, La.

[21] Appl. No.: 269,067

[22] Filed: Jun. 30, 1994

[51] Int. Cl.[6] ..... B08B 3/02

[52] U.S. Cl. ..... 239/289; 15/316.1; 15/328; 122/390; 134/95.3; 134/167 C; 134/172; 239/391; 239/DIG. 13

[58] Field of Search ..... 134/115 R, 167 C, 134/168 C, 172, 95.3; 239/289, 391, 396, DIG. 13; 15/328, 316.1, 317, 318, 318.1; 122/379, 390, 392; 68/222

[56] References Cited

U.S. PATENT DOCUMENTS

| | | | |
|---|---|---|---|
| 1,809,221 | 6/1931 | Snow et al. | 122/392 |
| 3,133,701 | 5/1964 | McClenahan | 239/289 X |
| 4,209,028 | 6/1980 | Shenker | 134/167 C X |
| 5,063,632 | 11/1991 | Clark et al. | 15/316.1 |

FOREIGN PATENT DOCUMENTS

| | | | |
|---|---|---|---|
| 2423 | of 1915 | United Kingdom | 122/390 |

*Primary Examiner*—Philip R. Coe
*Attorney, Agent, or Firm*—Harness, Dickey & Pierce

[57] ABSTRACT

A lance tube for a sootblower device for cleaning internal surfaces of large scale combustion devices. The lance tube includes two sets of nozzles for ejecting fluid cleaning media. A readily accessible fluid flow restriction device is positioned between the two sets of nozzles and accommodates interchangeable plug elements providing different fluid flow restrictions. One set of nozzles is optimized for steam as the cleaning media whereas the other is designed for ejecting water. This lance tube configuration is especially adapted for selectively ejecting steam or water blowing medium as cleaning requirements dictate.

27 Claims, 3 Drawing Sheets

CONVERTIBLE MEDIA SOOTBLOWER LANCE TUBE

BACKGROUND AND SUMMARY OF THE INVENTION

This invention generally relates to sootblower devices which are used to project a stream of a fluid cleaning medium against internal surfaces of large scale combustion devices for cleaning the surfaces. In particular, this invention concerns a sootblower lance tube which can be readily adapted for use with different types of fluid cleaning media.

Sootblowers are used to project a stream of a fluid cleaning medium such as water, air or steam against internal surfaces of a combustion device such as large scale boilers to cause a range of slag and/or ash deposits to be removed through a process of mechanical impact and thermal shock. Various types of sootblowers are used. One general category of sootblowers is known as the retracting type. These devices have a retractable lance tube which is periodically advanced into and withdrawn from the combustion device, and may be simultaneously rotated such that one or more nozzles on the lance tube project a jet of cleaning medium which traces an appropriate cleaning path. In typical retracting sootblowers, a feed tube is held stationary relative to the sootblower frame which sets outside the combustion device. One end of the feed tube is supplied with the cleaning medium through a poppet valve. The lance tube slidably over-fits the feed tube and its longitudinal sliding and rotational motion is controlled by a carriage which moves along tracks on the sootblower frame. The cleaning medium supplied to the feed tube in turn pressurizes the hollow interior of the lance tube. The cleaning medium escapes from the lance tube through one or more nozzles which direct the spray against the surfaces to be cleaned. At the conclusion of a cleaning cycle, the lance tube is retracted and withdrawn from the combustion device to avoid exposure to the intense heat and/or corrosive atmosphere which would degrade or destroy the lance tube.

Various fluid cleaning media are used in sootblowers as a function of the particular cleaning requirements. Gaseous or vaporous fluids such as steam and air are used in many applications. In other instances a liquid cleaning medium, typically water is used, depending upon the sootblowing requirements. For simplicity, throughout the remainder of this description, the two categories of cleaning media will be referenced to inclusively as "steam" or "water". Lance tubes are typically manufactured exclusively for a particular type of sootblowing medium. Blowing of steam requires a nozzle specially configured for efficiently discharging such compressible media. In the case of water used as a sootblowing medium, specially designed nozzles are used which typically have a much smaller cross-sectional flow area than those used for steam. Unfortunately, a single nozzle configuration is not well suited for use with both steam or water due to the significant difference in the fluid characteristics of those media.

In some sootblowing applications there is a need to periodically change the sootblowing medium being used in response to changing cleaning requirements within the combustion device. In the past, a change of the sootblowing medium would typically involved a complete change of the lance tube, with one having nozzles intended for steam and another especially designed for spraying water. Designs having interchangeable nozzles have been considered but are problematic since the lance tube operates in a hostile environment, and accordingly, threads or other precision mating surfaces tend to become degraded in service, making removal and replacement of special nozzles difficult. Examples of such convertible designs include lance tubes having threaded-in nozzle bushings, and a design in which the tip of the lance tube is threaded to the main lance tube section. These approaches are however, unsuitable for the reasons mentioned above.

In the absence of a means for changing the flow nozzle, switching the sootblowing medium suffers from the disadvantageous requirement that the entire lance tube be removed from the sootblower, and thus the task of replacing the lance tube is a significant and time consuming effort and further takes the cleaning equipment out of service for an extended period.

One approach toward providing a convertible sootblower lance tube is described by U.S. Pat. No. 4,209,028 assigned to the assignee of the present invention. That patent describes a sootblower lance tube adapted for discharging steam or water which has a pair of axial displaced nozzles, one designed specifically for each of the cleaning media. A thermostatically operable valve is inter-posed between the nozzles which closes off the distally located steam nozzle when liquid at a temperature lower than that of steam is in the lance tube. Although that design is believed operable, it is perceived to have several shortcomings. In particular, actuation could be hampered by internal fouling of the lance tube. In addition, the mechanism has a number of moving parts, giving rise to reliability concerns. That unit moreover, responds over time to a change in the fluid cleaning media being supplied. Accordingly, there is some actuation time lapse following a change in media. Due to its automatic operation, the system according to the previously mentioned patent would not provide a positive indication that a change in nozzle discharge has occurred, thus making affirmative verification of proper operation difficult. Fluid supply pressures may also have to be limited in utilizing a design according to the previously mentioned patent since the moveable valve described therein must close off high pressure water flow when switching from steam to water.

In view of the foregoing, there is a need to provide a sootblower lance tube which is readily adapted for discharging steam or water sootblowing media. Ideally, such a conversion could be made with a minimal down time and would be performed using mechanisms which would withstand the hot and corrosive environment in the interior of the combustion device.

In accordance with the present invention, a sootblower lance tube is provided with means to enable such rapid conversion between cleaning media. This is achieved by providing a pair of nozzle groups, with one or more steam nozzles being placed near the distal end of the lance tube, and one or more water nozzles being located longitudinally displaced from the steam nozzles toward the proximal end of the lance tube. Between the two groups of nozzles is placed a fluid flow control means, which in one embodiment incorporates a plug element which can be externally manually removed and replaced in a plug block mounted along the lance tube. At least two different plug element configurations are implemented, one of which is intended for steam discharge having a low restriction flow passage therethrough which allows steam supplied to the hollow interior of the lance tube to readily flow to the distal steam nozzles. Although a portion of the steam may also discharge from the water nozzles in some applications, this flow is a small proportion of the total output, given the relatively small diameter and consequently higher fluid flow restriction posed by the water nozzles. This flow is however useful in keeping the water nozzles cleared. Another plug element for water discharge provides a relatively high restriction flow path which causes water supplied to the lance tube to flow through the water nozzles. Preferably for most applications, a proportionately small flow of water is however, permitted to pass to the steam nozzles to provide a cooling effect for the distal end of the lance tube. In a preferred embodiment of a plug element for water cleaning, a spray nozzle is provided in the plug element which disperses water on the inside surfaces of the distal end of the lance tube to enhance the cooling effect provided.

In a second embodiment of this invention the fluid flow control means comprises a manually operable valve element in which a gate plate is rotatable within a plate block between two positions. In one position, the gate plate allows for a free flow of fluid through the valve assembly for steam cleaning. In a rotated second position, the flow of fluid is substantially restricted for use with water with the exception of a minute flow for cooling purposes as in the prior embodiment.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
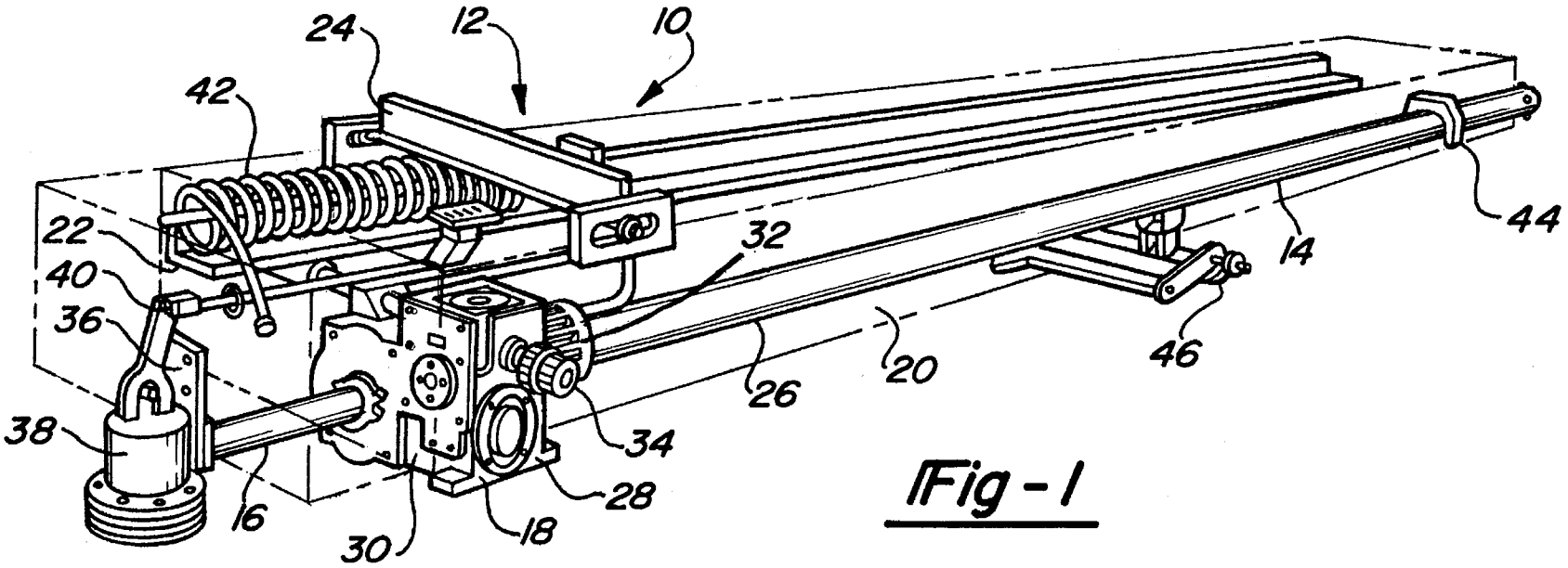
FIG. 1 is a pictorial view of a long retracting sootblower which is one type of sootblower which may incorporate the novel lance tube of the present invention.

A representative sootblower which may incorporate the features of the present invention is shown in FIG. 1 and is generally designated there by reference number 10. Sootblower 10 principally comprises frame assembly 12, lance tube 14, feed tube 16, and carriage 18. Sootblower 10 is shown in its normal retracted resting position. Upon actuation, lance tube 14 is extended into and retracted from a combustion device and may be simultaneously rotated.

Frame assembly 12 includes a generally rectangularly shaped frame box 20 which forms a housing for the entire unit. Carriage 18 is guided along two pairs of tracks located on opposite sides of frame box 20, including a pair of lower tracks (not shown) and upper tracks 22. A pair of toothed racks (not shown) is rigidly connected to upper tracks 22 and is provided to enable longitudinal movement of carriage 18. Frame assembly 12 is supported by a wall box (not shown) which is affixed to the combustion device wall or another mounting structure and is further supported by rear support brackets 24.

Carriage 18 drives lance tube 14 into and out of the combustion device and includes drive motor 26 and gear box 28 which is enclosed by housing 30. Carriage 18 drives a pair of pinion gears 32 which engage the toothed racks to advance the carriage and lance tube 14. Support rollers 34 engage the guide tracks to support carriage 18.

Feed tube 16 is attached at one end to rear bracket 36 and conducts the flow of fluid cleaning medium which is controlled through the action of poppet valve 38. Poppet valve 38 is actuated through linkages 40 which are engaged by carriage 18 to begin cleaning medium discharge upon extension of lance tube 14, and cuts off the flow once the lance tube and carriage return to their idle retracted position, as shown in FIG. 1. Lance tube 14 over-fits feed tube 16 and a fluid seal between them is provided by a packing. The steam or water sootblowing medium flows through the hollow interior of lance tube 14 and exits through one or more nozzles which are described in more detail later in this description.

Coiled electrical cable 42 conducts power to the drive motor 26. Front support bracket 44 having rollers 45 supports lance tube 14 during its longitudinal and rotational motion. For long lance tube lengths, an intermediate support 46 may be provided to prevent excessive bending deflection of the lance tube. Additional details of the construction of the well-known design of "IK" types of sootblowers manufactured by assignee can be found with reference to U.S. Pat. Nos. 3,439,376 and 4,803,959, which are hereby incorporated by reference.

Figure 2:
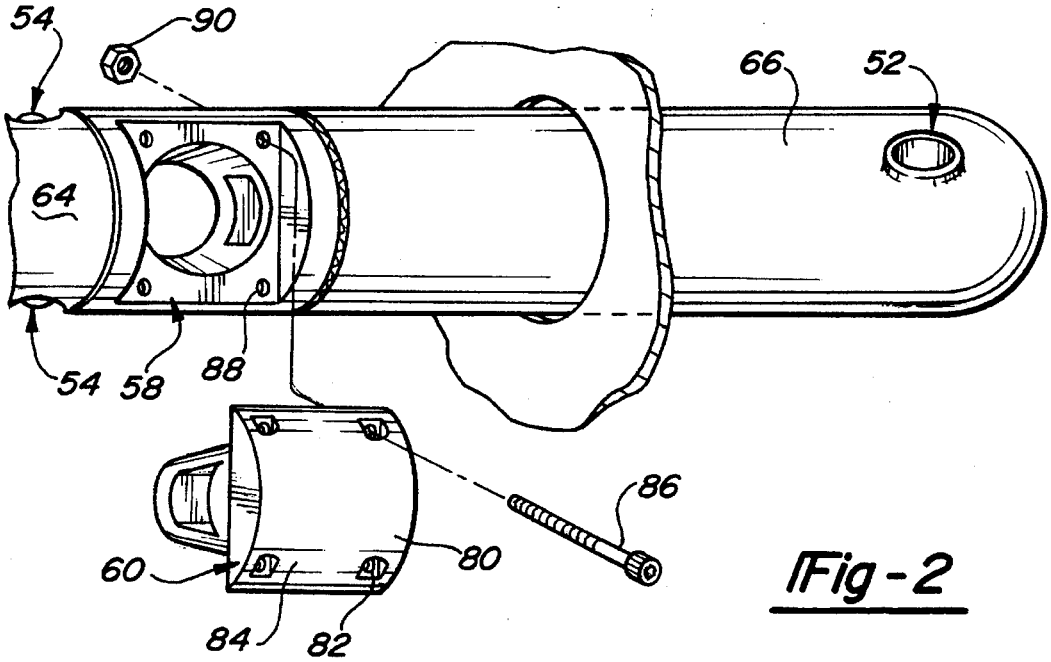
FIG. 2 is a pictorial view of the distal end of a convertible media sootblower lance tube in accordance with this invention showing a plug element for steam blowing in an exploded position.
Figure 3:
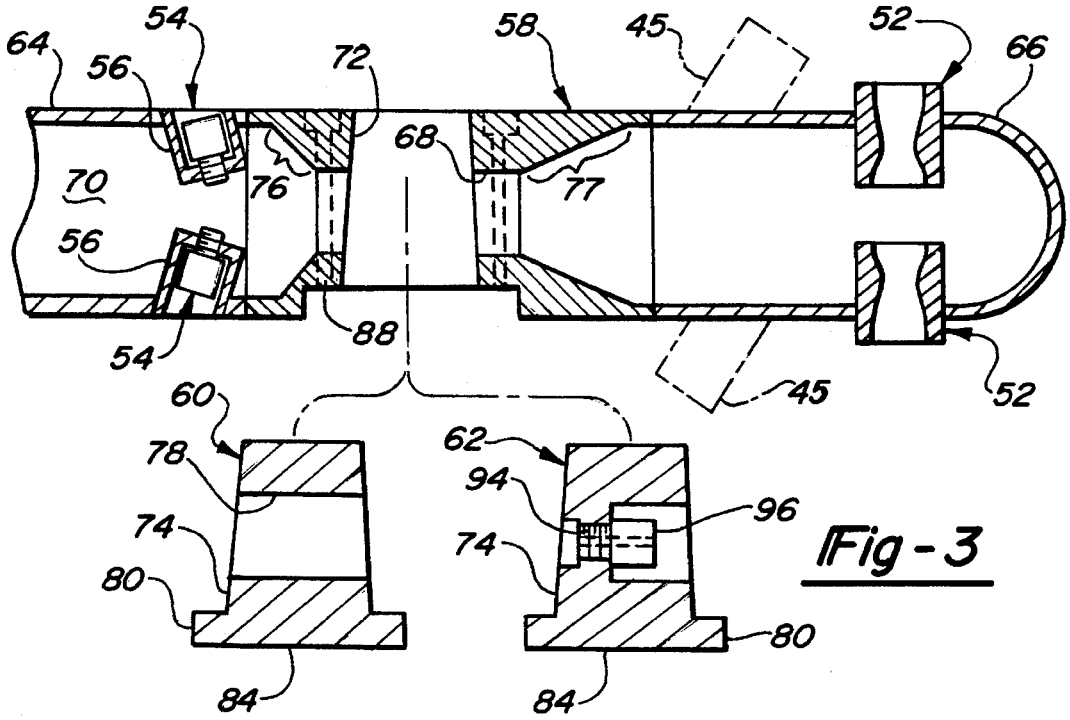
FIG. 3 is a longitudinal cross-sectional view through the lance tube end of FIG. 2 showing two alternate plugs which can be incorporated for preferential blowing of steam or water cleaning media.
Figure 4:
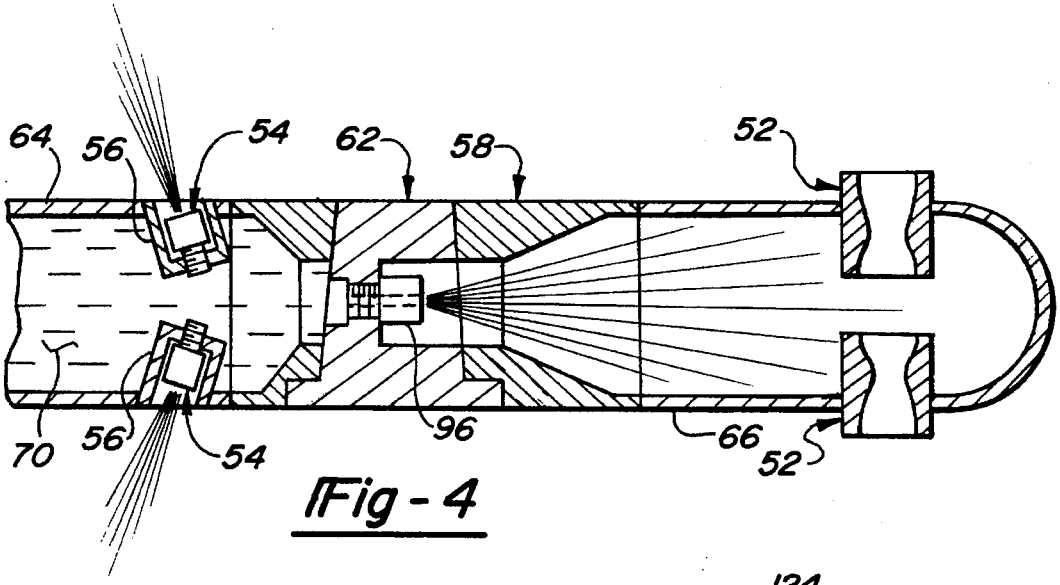
FIG. 4 is a longitudinal cross-sectional view of a lance tube incorporating the water cleaning plug element showing the manner provided for cooling the lance tip.

Now with reference with FIGS. 2 through 4, novel aspects of lance tube 14 are shown in detail. At the distal end of lance tube 14 is provided steam nozzles 52. In the illustrations, two steam nozzles 52 are provided. However, in some instances a single steam nozzle may be used or a greater number may be incorporated as needed. Steam nozzles 52 have an internal venturi shaped configuration best suited for efficiently ejecting a compressible expanding medium in a concentrated spray stream at a high flow rate.

Longitudinally displaced from steam nozzles 52 toward the proximal end of lance tube 14 is provided a group of water nozzles 54. Water nozzles 54 are shown at a slight backrake angle, that is, they are inclined toward the lance tube proximal end from perpendicular to the lance tube. Other orientations can be provided as needed. In the illustrations, two water nozzles 54 are shown (see FIG. 2). Again, however a single or a larger number can be provided as cleaning requirements dictate. Water nozzles 54 have a significantly smaller cross-sectional flow area as compared with steam nozzles 52 since they are optimized for the ejection of water. Nozzles 54 are shown threaded into sockets 56 but could alternately be welded in place.

As mentioned previously, due to the significant differences in fluid characteristics, steam nozzles 52 are unsuitable for water cleaning, and similarly, water nozzles 54 are not optimal for the discharge of steam. For example, if the steam nozzles 52 were used for water, an extremely high volumetric flow rate would be necessary to generate sufficient back pressure to cause the stream to travel a long distance with a high impact pressure. Such a discharge of water would have undesirable effects on boiler operation and would lead to thermal damage of internal boiler components. Conversely, the small diameter flow passages of water nozzles 54 in turn would not discharge a sufficient volumetric flow rate of steam to provide efficient cleaning operation.

In accordance with the present invention a means for providing fluid flow control having a manually operable element is imposed within lance tube 14 between steam nozzles 52 and water nozzles 54. In accordance with a first embodiment of this invention, this function is performed by plug block 58 and one of removable plugs 60 or 62. As shown, plug block 58 is generally cylindrical and has an outside diameter which corresponds to that of lance tube 14. Plug block 58 is butt welded to main lance tube section 64 and to distal lance tip 66. Plug block 58 has a central flow passageway 68 which conducts the cleaning medium which flows through lance tube hollow interior 70. Plug block 58 also defines a transverse bore 72 which is preferably of a frustro-conical or tapered configuration. Plug block 58 accommodates either plug 60 or plug 62 which provide a manually operable means for providing a variable fluid flow restriction between the sets of nozzles.

Plug 60 is used when it is desired to discharge steam for cleaning. Plug 60 has an outside surface 74 which closely matches that of plug block transverse bore 72. In fact, the two surfaces are configured such that plug 60 can be tightly driven into transverse bore 72 in a manner that prevents significant fluid leakage. To further enhance sealing, graphite or other sealing materials can be used to form a seal between the mating surfaces. Plug 60 further has a cross-sectional central passageway 78 which has a flow area equivalent to that of plug block flow passageway 68. Plug 60 is intended to provide a minimal flow restriction through plug block 58. With that intent in mind, as shown in FIG. 3, plug block central flow passageway may define a venturi like configuration in which the steam as it flows from the proximal to distal lance tube ends first encounters a decreasing flow area in region 76 and then a more gradual expansion area in region 77 (to minimize pressure drop). In order to facilitate mounting of plug 60 to plug block 58, a mounting flange 80 is provided having a series of four mounting bolt bores 82. The external surface 84 of mounting flange 80 has a semi-cylindrical configuration such that when plug 60 is mounted in position, a smooth outer cylindrical lance surface is provided. Four cap bolts 86 ( or other suitable fasteners) pass through mounting flange bores 82 and through corresponding plug block bores 88 and threaded nuts 90 are used to engage the cap bolts to clamp plug 60 in position.

In operation, when plug 60 placed within plug block 58, a relatively unobstructed pathway for the flow of steam is provided. Steam is provided through appropriate plumbing and upon travelling within the hollow interior of the lance tube, travels through plug block 58 and is ejected from steam nozzles 52. Although a small fraction of the total steam flow may be ejected from water nozzles 54 in some applications, the higher fluid flow restriction posed by the water nozzles restricts that portion of flow. Accordingly, steam nozzles 52 are principally used for ejecting the steam blowing medium. The relatively small flow of steam through water nozzles 54, although not appreciably contributing to cleaning in most cases, would act to purge the water nozzles to reduce the likelihood (not shown) of plugging by ash. In some cases, it may be desirable to insert stoppers or plugs into water nozzles 54 in such modes of operation.

Plug 62 is best shown in FIGS. 3 and 4 and is installed when it is desired to eject water from lance tube 14. Plug 62 has a number of features common to that of plug 60 which are identified by like reference numbers and are identical to those common features described above. The difference between the plugs, however, is with respect to the degree of fluid flow restriction which they impose. Water spray nozzle 96 is mounted within the threaded central passageway 94 of plug 62 and is intended to provide a small cross-sectional area, high flow resistance passageway as a means of restricting the flow of water therethrough. Water spray nozzle 96 creates a high restriction to the flow of water thus directing a majority of water flowing into lance tube interior passageway 70 through water nozzles 54. In addition to acting as a flow restriction, water spray nozzle 96 also provides a secondary benefit. Water spray nozzle 96 is designed to disburse water and therefore, when water is used as a cleaning medium it is sprayed against the inside surfaces of lance tip 66 for cooling, as illustrated in FIG. 4. Although a small fraction of the water being transported through the lance tube 14 exits the steam nozzles 52 as vapor, that proportional flow rate is small and thus the majority of the water is ejected from water nozzles 54 to provide the desired cleaning effect.

In some cases it may be possible to use a solid plug (not shown) for water cleaning which completely prevents water from flowing into lance tip 66 where cooling requirements are not of concern. Solid plugs may also be substituted for the water nozzles in applications where steam flow through these nozzles is not desired.

Plugs 60 and 62 are designed to be conveniently manually removed from plug block 58 as needed. Since the ends of plugs 60 and 62 opposite mounting flange 80 are exposed, the plugs can be forcibly driven from their seated position within plug block 58 using an impact tool. As mentioned previously, threaded components are problematic when exposed to the boiler environment. It can be anticipated therefore, that if threaded cap bolts 86 and nuts 90 are used they will become fouled in use, rendering loosening difficult or impossible. Due to the accessibility of these fasteners however, they can be easily sacrificially removed without damaging other components and replaced with readily available new fasteners.

In order to facilitate the process of changing between plugs 60 and 62 based on cleaning requirements, plug block 58 is preferably located along lance tube 14 so that it is readily accessible while the lance tube is in its normal retracted position. With this goal in mind, plug block 58 is located toward the proximal end from the position from support rollers 45 shown in phantom lines in FIG. 3 where it is easily accessed.

Figure 5:
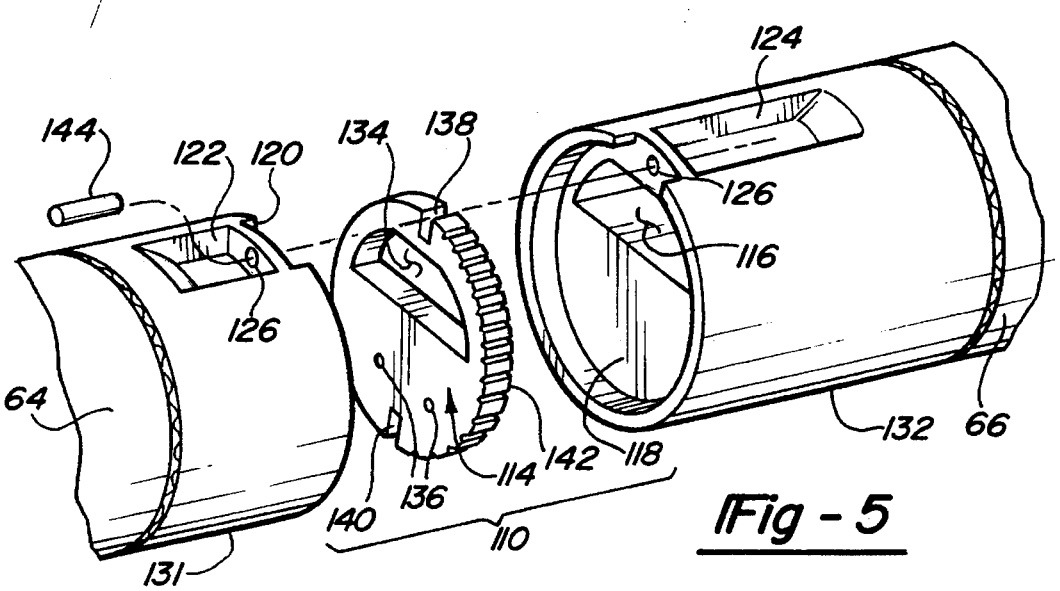
FIG. 5 is an exploded pictorial view of a lance tube in accordance with a second embodiment of this invention incorporating a flow control means in the form of a manually actuated valve assembly.
Figure 6:
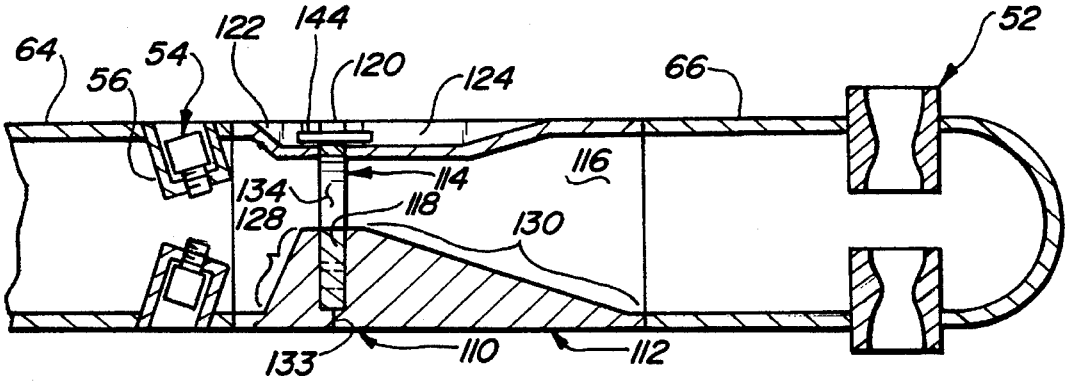
FIG. 6 is a longitudinal cross-sectional view through the lance tube end shown in FIG. 5.

Now with reference to FIGS. 5 and 6 a second embodiment of a fluid flow control means in accordance with this invention is described which enables sootblower 10 to be convertible between steam and air fluid cleaning media. In accordance with this embodiment, valve assembly 110 is provided which, like plug block 58 previously described, is installed between the main lance tube section 64 and lance tip 66.

Valve assembly 110 principally comprises plate block 112 and gate plate 114. Plate block 112 defines a cylindrical outer surface which matches that of lance tube 14. Central passageway 116 is offset from the center line of the lance tube and is open on one side of a diametric center plane of the internal diameter of plate block 112, as best shown in FIG. 5 and 6. A transverse oriented gate plate slot 118 is provided which opens to the exterior at aperture 120. Plate block 112 has recesses 122 and 124 which provide access to roll pin bore 126. As in the prior embodiment, plate block central passageway 116 has a configuration which minimizes the flow restriction when it is desired to discharge steam. To that end, passageway 116 includes a rapidly decreasing flow area in region 128 and then a more gradual expansion area in region 130. Plate block 112 is preferably made of stainless steel and could be made in two pieces 131 and 132 as shown with a circumferential joint line 133 being present in the area of gate plate slot 118. The two separately fabricated pieces are welded together trapping gate plate 114 in its proper location in slot 118.

Gate plate 114 is best shown with reference to FIG. 5. Gate plate 114 is a circular disk in which one-half of the plate is mostly milled out to create a large area steam flow passage 134. The opposing half of gate plate 114 is fully blocked with the exception of a pair of cooling holes 136. Displaced at 180° around the perimeter of the plate are a pair of notches 138 and 140. Between the notches around the perimeter of the gate plate is a series of regularly spaced actuation notches 142. Gate plate 114 has a thickness such that it is tightly trapped within plate block slot 118.

Gate plate 114 is preferably made of brass or another non-weld material of appropriate temperature resistance. In an envisioned embodiment of this device, plate 114 would have a thickness of 0.50 inches and a diameter of 3.25 inches.

In operation, when it is desired to discharge steam, gate plate 114 rotationally oriented is such that steam flow passage 134 is aligned with plate block central passage 116, as shown in FIG. 6. In this configuration, very little restriction to the flow of steam is provided such that steam is permitted to be discharged from steam nozzles 52. Plate block 112 is maintained in this position by installing roll pin 144 through bore 126 and through gate plate notch 138.

When it is desired to convert sootblower 10 to water discharge operation, gate plate 114 is externally manually actuated to rotate 180°. This is accomplished by first removing roll pin 144. Using an appropriate actuation tool such as a screw driver or chisel gate plate 114 is indexed 180° by engaging actuation notches 142 through plate block aperture 120. Once gate plate 114 is rotated a full 180°, roll pin 144 can be reinstalled, in this case passing through gate plate aperture 140. In this condition, the flow of water cleaning media through plate block 112 is restricted with the exception of a minute flow through cooling holes 136. As with the prior embodiment, this minute water flow is provided for cooling lance tube tip 66.

Preferably at each fluid cleaning media change, the outer edge of gate plate 114 is lubricated by applying lubricant at the gate plate access hole 120 and then rotating the gate plate several full revolutions to insure that gate plate 114 is fully coated with lubricant.

In order to implement this invention with either embodiment, some means of providing either steam or water to the lance tube is needed. Such plumbing and valving systems are well known to those skilled in the art and could take numerous forms.

While the above description constitutes the preferred embodiments of the present invention, it will be appreciated that the invention is susceptible of modification, variation and change without departing from the proper scope and fair meaning of the accompanying claims.

We claim:

1. A lance tube for a sootblower device for cleaning surfaces of a combustion device in which said lance tube is periodically advanced into and withdrawn from said combustion device, said lance tube having a hollow interior for conducting a fluid cleaning medium which is ejected from nozzles carried by said lance tube, said lance tube comprising:

at least one first nozzle affixed to said lance tube, at least one second nozzle affixed to said lance tube, wherein said first and second nozzles have differing fluid flow characteristics, and fluid flow control means affixed to said lance tube having a plug seat mounted to said lance tube defining a longitudinal flow passageway within said lance tube hollow interior and interposed in a fluid flow path between said first and second nozzles and said plug seat having a transverse passageway, said fluid control means further having a removable plug adapted to be positioned in said plug seat transverse passageway and having a flow passageway whereby the resistance to flow of said cleaning medium through said fluid flow control means set by said plug flow passageway influences the relative flow rates of said cleaning medium discharged by said first and second nozzles.

2. A lance tube according to claim 1 wherein said first nozzle is affixed to said lance tube adjacent to a distal end of said lance tube and said second nozzle is longitudinally displaced from said first nozzle toward a proximal end of said lance tube.

3. A lance tube according to claim 2 wherein said fluid flow control means is positioned longitudinally along said lance tube between said first and second nozzles.

4. A lance tube according to claim 2 wherein said first nozzle provides a lower resistance flow path for said cleaning medium as compared with said second nozzle.

5. A lance tube according to claim 4 wherein said first nozzle is optimized for use with a gaseous or vaporous cleaning medium and said second nozzle is optimized for use with a liquid cleaning medium.

6. A lance tube according to claim 1 wherein said plug flow passageway is aligned with and complementary with said plug seat longitudinal flow passageway thereby providing a low level of restriction of the flow of said fluid cleaning medium whereby said cleaning medium flows at a greater volumetric flow rate through said first nozzle as compared with said second nozzle.

7. A lance tube according to claim 1 wherein said plug flow passageway having a cross-sectional flow area substantially smaller than said plug seat longitudinal flow passageway thereby providing a high level of restriction of the flow of said cleaning medium whereby said cleaning medium flows at a greater volumetric flow rate through said second nozzle as compared with said first nozzle.

8. A lance tube according to claim 7 further comprising a spray nozzle within said plug flow passageway whereby cleaning medium is sprayed onto inside surfaces of said lance tube for cooling portions of said lance tube.

9. A lance tube according to claim 1 wherein said plug seat transverse passageway having a tapered configuration enabling said plug to be forcibly driven into sealing engagement with said plug seat transverse passageway.

10. A lance tube according to claim 1 wherein said plug seat transverse passageway passes completely through said plug seat.

11. A lance tube according to claim 1 wherein said plug having an enlarged flange having at least one bore for receiving a fastener which further engages said plug seat.

12. A lance tube according to claim 1 wherein said fluid flow control means permits at least some level of flow of said cleaning medium through both said first and second nozzles.

13. A lance tube for a sootblower device for cleaning surfaces of a combustion device in which said lance tube is periodically advanced into and withdrawn from said combustion device, said lance tube having a hollow interior for conducting a fluid cleaning medium which is ejected from nozzles carried by said lance tube, said lance tube adapted to be converted either for discharging a first gaseous or vaporous cleaning medium, or a second liquid cleaning medium, said lance tube comprising:

at least one first nozzle affixed to said lance tube configured for discharging said first cleaning medium and mounted to said lance tube adjacent a distal end thereof, at least one second nozzle affixed to said lance tube configured for discharging said second cleaning medium and mounted to said lance tube longitudinally displaced from said first nozzle toward a proximal end of said lance tube, and fluid flow means affixed to said lance tube defining a flow passageway within said lance tube hollow interior and interposed between said first and second nozzles whereby the resistance to flow of said cleaning medium through said fluid flow control means influences the relative flow rates of said cleaning medium discharged by said first and second nozzles, said fluid flow control means incorporating a first plug element intended for use with said first cleaning medium providing a relatively low fluid flow restriction whereby said first cleaning medium is discharged predominately through said first nozzle, and interchangeably incorporating a second plug element intended for use with said second cleaning medium providing a relatively high fluid flow restriction whereby said second cleaning medium is discharged predominantly through said second nozzle.

14. A lance tube according to claim 13 wherein said fluid flow control means comprises a plug seat mounted to said lance tube having a longitudinal passageway communicating with said lance tube hollow interior and a transverse passageway for interchangeably receiving either said first or second plug elements.

15. A lance tube according to claim 13 further comprising a spray nozzle within said second plug flow passageway whereby cleaning medium is sprayed onto inside surfaces of said lance tube for cooling portions of said lance tube.

16. A lance tube according to claim 13 wherein said fluid flow control means permitting at least some level of flow of said first cleaning medium through said second nozzle when said first plug is installed in said plug seat and permitting at least some level of flow of said second cleaning medium through said first nozzle when said second plug is installed.

17. A lance tube according to claim 13 wherein said plug seat transverse passageway having a tapered configuration enabling said plugs to be forcibly driven into sealing engagement with said plug seat transverse passageway.

18. A lance tube according to claim 13 wherein said plug seat transverse passageway passes completely through said plug seat.

19. A lance tube according to claim 13 wherein said plugs having an enlarged flange having at least one bore for receiving a fastener which further engages said plug seat.

20. A lance tube for a sootblower device for cleaning surfaces of a combustion device in which said lance tube is periodically advanced into and withdrawn from said combustion device, said lance tube having a hollow interior for conducting a fluid cleaning medium which is ejected from nozzles carried by said lance tube, said lance tube adapted to be converted either from discharging a first gaseous or vaporous cleaning medium, or a second liquid cleaning medium, said lance tube comprising:

at least one first nozzle affixed to said lance tube configured for discharging said first cleaning medium and mounted to said lance tube adjacent a distal end thereof, at least one second nozzle affixed to said lance tube configured for discharging said second cleaning medium and mounted to said lance tube longitudinally displaced from said first nozzle toward a proximal end of said lance tube, and a valve assembly affixed to said lance tube defining a flow passageway within said lance tube hollow interior and interposed between said first and second nozzles whereby the resistance to flow of said cleaning medium through said valve assembly influences the relative flow rates of said cleaning medium discharged by said first and second nozzles, said valve assembly having a cylindrical plate block forming a flow passage on one side of a diameter center plane thereof and defining a circular transverse slot retaining a gate plate having an opening, whereby in said first position, said gate plate opening is aligned with said flow passage and when rotated in said transverse slot to said second position, said gate plate block said flow passage.

21. A lance tube for a sootblower device for cleaning surfaces of a combustion device in which said lance tube is periodically advanced into and withdrawn from said combustion device, said lance tube having a hollow interior for conducting a fluid cleaning medium which is ejected from one or more nozzles carried by said lance tube, said lance tube comprising:

at least one first nozzle affixed to said lance tube, at least one second nozzle affixed to said lance tube, wherein said first and second nozzles have differing fluid flow characteristics, and a valve assembly affixed to said lance tube defining a flow passageway within said lance tube hollow interior and interposed in a fluid flow path between said first and second nozzles and having a manually actuated valve element moveable between two positions, including a first position providing a low resistance to said flow of said cleaning medium and a second position providing a high resistance said flow of said cleaning medium whereby the resistance to flow of said cleaning medium through said valve assembly set by said valve element influences the relative flow rates of said cleaning medium discharged by said first and second nozzles.

22. A lance tube according to claim 21 wherein said first nozzle is affixed to said lance tube adjacent to a distal end of said lance tube and said second nozzle is longitudinally displaced from said first nozzle toward a proximal end of said lance tube.

23. A lance tube according to claim 22 wherein said valve assembly is positioned longitudinally along said lance tube between said first and second nozzles.

24. A lance tube according to claim 22 wherein said first nozzle provides a lower resistance flow path for said cleaning medium as compared with said second nozzle.

25. A lance tube according to claim 24 wherein said first nozzle is optimized for use with a gaseous or vaporous cleaning medium and said second nozzle is optimized for use with a liquid cleaning medium.

26. A lance tube according to claim 21 wherein said valve assembly permits at least some level of flow of said cleaning medium through both said first and second nozzles.

27. A lance tube according to claim 21 wherein said valve assembly comprises a cylindrical plate block forming a flow passage on one side of a diametric center plane thereof and defining a circular transverse slot retaining a gate plate having an opening, whereby in said first position, said gate plate opening is aligned with said flow passage and when rotated in said transverse slot to said second position, said gate plate blocks said flow passage.

* * * * *